United States Patent [19]

Garcia et al.

[11] Patent Number: 4,888,833

[45] Date of Patent: Dec. 26, 1989

[54] CART FOR POSITIONING A BODY ON A TOILET

[76] Inventors: Gilbert C. Garcia, 163 Tabard Dr., San Antonio, Tex. 78213; Rodolfo G. Valdes, 11011 Reverie La., San Antonio, Tex. 78216

[21] Appl. No.: 155,882

[22] Filed: Feb. 16, 1988

[51] Int. Cl.[4] ..... A61G 7/02; A47K 11/04

[52] U.S. Cl. ..... 4/480; 4/251; 280/304.1; 297/339

[58] Field of Search ..... 4/251, 254, 480; 297/339, DIG. 4; 280/242 WC, 289 WC

[56] References Cited

U.S. PATENT DOCUMENTS

| | | | |
|---|---|---|---|
| 3,473,174 | 10/1969 | Cool | 297/339 X |
| 4,007,959 | 2/1977 | Juergens | 4/480 X |
| 4,067,409 | 1/1978 | DiMatteo | 4/480 X |
| 4,168,552 | 9/1979 | Austin | 4/254 X |
| 4,185,335 | 1/1980 | Alvis | 4/251 |
| 4,266,305 | 5/1981 | Kavaloski | 4/480 |
| 4,399,572 | 8/1983 | Johansson | 4/251 X |
| 4,587,678 | 5/1986 | Love | 4/480 X |
| 4,613,994 | 9/1986 | Oates | 280/289 WC X |

*Primary Examiner*—Harvey C. Hornsby
*Assistant Examiner*—K. O'Leary
*Attorney, Agent, or Firm*—Cox & Smith, Inc.

[57] ABSTRACT

This invention provides a cart for positioning an individual's body on a toilet. It is particularly advantageous for transporting a handicapped person to such toilet and automatically aligning the handicapped person's body above the toilet. The cart has castors for easy rolling and also has guiding rollers that center the individual's body over the toilet when the cart is rolled backwardly over the toilet. The invention also incorporates a pneumatic system for raising the individual's body above the height of the toilet's seat when the body is pushed over the toilet and for, subsequently, lowering the individual's body onto the toilet seat in a position that enables use of the toilet by the individual.

11 Claims, 2 Drawing Sheets

CART FOR POSITIONING A BODY ON A TOILET

BACKGROUND OF THE INVENTION

The present invention relates to an apparatus for transporting an individual and for positioning such individual on a toilet in a position which enables use of the toilet by the individual. More particularly, the present invention relates to a cart upon which an individual may be seated for centering the excretory organs of the individual's body over the opening of a toilet and lowering the individual's body onto the seat of the toilet, thereby enabling use of the toilet.

The process of using a toilet is one which most individuals perform with little difficulty, but the process can be much more difficult for handicapped individuals. Handicapped individuals, particularly those who have little use of their legs or arms (such as quadriplegics), must often have assistance when utilizing a toilet. Their difficulties range from inability to initiate the natural excretory process, to difficulties in cleansing their body surface of waste material after defecation, and even to difficulties in remaining seated on the toilet.

Accordingly, a variety of apparatus have been designed for further enabling handicapped individuals to perform such tasks which most people merely take for granted. For instance, Applicant's co-pending application, Ser. No. 052,720, filed May 20, 1987, discloses an automated apparatus adaptable to a commode for cleansing residual wastes from an individual's body surface. The preferred embodiment of that invention seals the private parts of the individual's body in a space common with the excretion chamber of a commode and, once sealed, a variety of fluids are directed onto those private parts for cleaning and drying them without directing the fluids beyond the sealed space. Applicant, however, has discovered that typical handicapped individuals for whom that invention is ideally useful have a critical need to be given further assistance in order to take advantage of the invention——namely, they have the need to properly position themselves on the seat of the toilet. It is, thus, an object of the present invention to enable proper positioning of handicapped individual on the seat of a toilet, such as on the seat of the invention of Applicant's previously mentioned co-pending application as adapted to a commode. Further, it is an object of the present invention to enable sealing of a space in common with the toilet's excretion chamber while also enabling such proper positioning.

In the past, nurses are often necessary in order to transport a bed-ridden handicapped individual to a toilet and in order to subsequently position such handicapped individual on the toilet. Such a nurse is often required regardless of whether the toilet is an ordinary toilet or one such as that of Applicant's previously mentioned co-pending application. Typically, such a nurse must manually carry the individual to the toilet and then place the individual on the toilet seat. Special care must be taken to avoid hazards related to dropping the individual and related to improperly placing the individual on the toilet. The proper placement on the toilet seat can especially be a problem when (as is common) there is little extra space adjacent the toilet, in which extra space the nurse could otherwise maneuver It is a primary object of Applicant's present invention to provide a single apparatus for enabling both transport of an individual's body to a toilet and subsequent proper positioning of that body relative to the toilet.

Several other objectives are advantageous, if not necessary. Most basically, it is an object of the present invention to provide an easily movable carriage for transporting an individual to a toilet and for subsequently enabling positioning of the individual's body in an appropriate position on the seat of the toilet. For practical reasons, such as for minimizing costs and for minimizing the necessary tasks of an assistant, it is a further object of the present invention to provide a body transport which readily enables positioning of the body in an operative position relative to a toilet while minimizing adjustments necessary to effectuate such transport and positioning.

Further, particularly since handicapped individuals are especially vulnerable to injury, it is another object of the present invention to minimize the possibility of injury to a person utilizing or attempting to utilize the present invention.

It is yet another object of the present invention to enable centering of the excretory organs of a transported individual's body relative to the excretion chamber opening of the toilet.

Many other objects, features, and advantages of the present invention will become evident to those skilled in the art in light of the following descriptions of the present invention. It is toward such objectives that the present invention is also directed.

SUMMARY OF THE PRESENT INVENTION

In striving to achieve the aforementioned objectives and others, Applicant has developed the present invention——a transport apparatus for transporting an individual, which apparatus is adapted for positioning the individual's excretory organs directly over the opening of the excretion chamber of a toilet, having a pneumatic system and guide rollers for automatically positioning the individual's body in an ideal position for use of the toilet.

Specifically, the present invention is provided with a seat for supporting the individual, and the seat is positionable over the toilet's excretion chamber opening with minimal adjustments. Even further, the seat is provided with an opening therethrough so that the individual need not reposition himself from a position for transport to a position for excretion, but rather may be transported and perform the excretory process in the same position. In addition to the basic advantage that the cart of the apparatus of the present invention is adapted to receive the toilet in a space beneath the seat supporting the individual, the preferred embodiment further includes guide rollers which guide the cart to a position in which the transported individual's excretory organs are automatically centered over the opening of the toilet. Furthermore, the pneumatic system enables raising of the transported individual's body above the height of the toilet seat when being positioned relative to the toilet seat, and subsequently enables lowering of the individual's body onto the toilet seat.

The preferred embodiment of the present invention is particularly adapted for use in conjunction with an automated body part cleaning apparatus somewhat similar to that of ApPlicant's co-pending application, Ser. No. 052,720. Because of the flexible nature of the seat of the preferred embodiment of the present invention, and for other reasons, a sealed space is enclosed beneath the body of the individual when the seat of the preferred embodiment the individual's body thereon are lowered onto the seat of the toilet. Such sealed space enables proper cleansing of the individual's body parts using apparatus such as that disclosed in Applicant's previously mentioned co-pending application.

Furthermore, the present invention offers protection in the event that the transported individual's body is carelessly placed or falls onto the preferred embodiment. Hand grips are provided for enabling physical control as well as for minimizing the possibility of harmful impact between the individual and the preferred embodiment. The characteristics of the flexible seat also enable comfort and protection. The provision of a single fundamental member defining the upper surface of the support structure of the preferred embodiment further minimizes the possibilities of harm to the individual since welds or other discontinuities on such upper surface would otherwise likely be adjacent the body of the individual should the individual fall in the preferred embodiment.

These and other advantages, objects and features of the present invention will become evident to those skilled in this art upon a reading of the following detailed description of the invention, taken in conjunction with the accompanying drawings and claims. The foregoing and following descriptions, however, are for exemplary purposes only, and the true spirit and scope of the invention is embodied in the appended claims.

DETAILED DESCRIPTION OF THE PREFERRED EMBODIMENT

Figure 1:
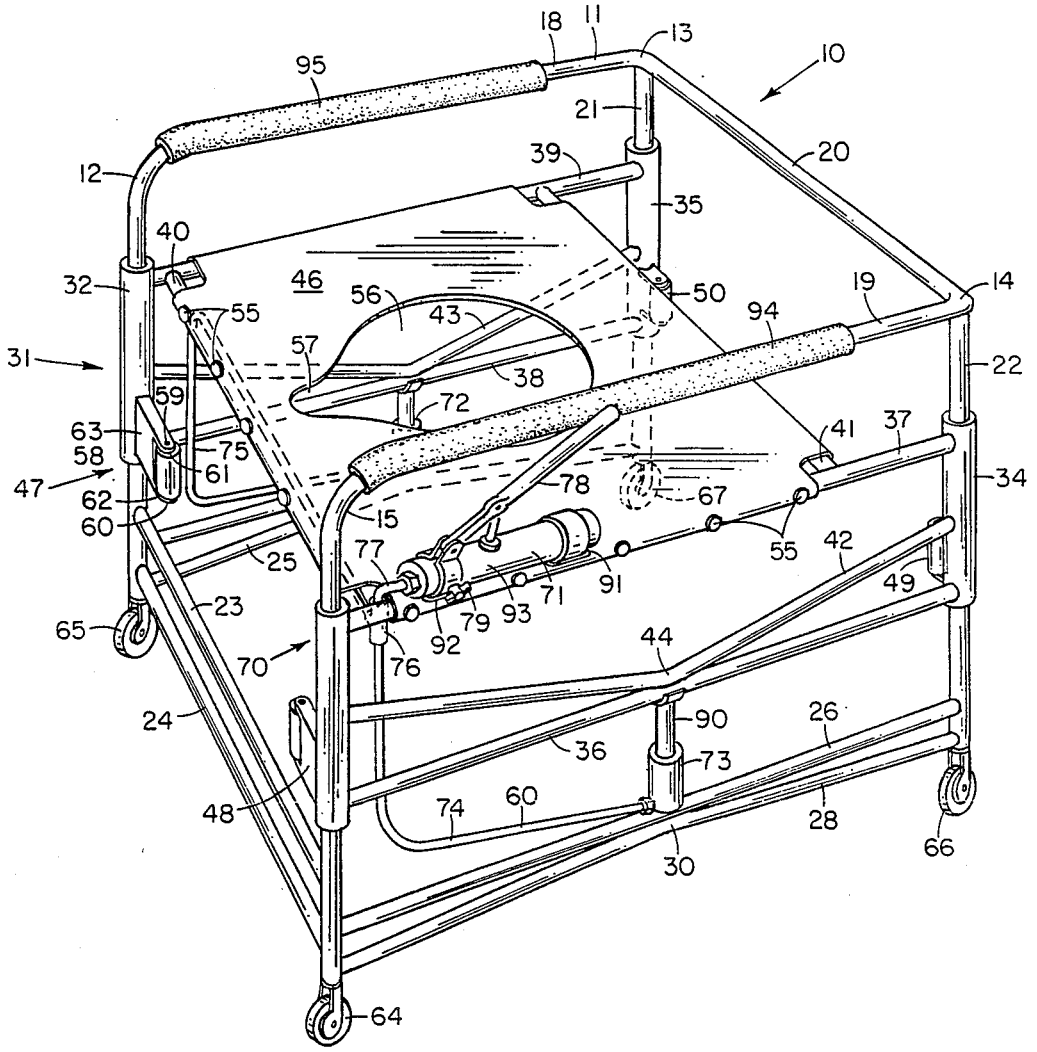
FIG. 1 is an isometric perspective of the preferred embodiment.
Figure 2:
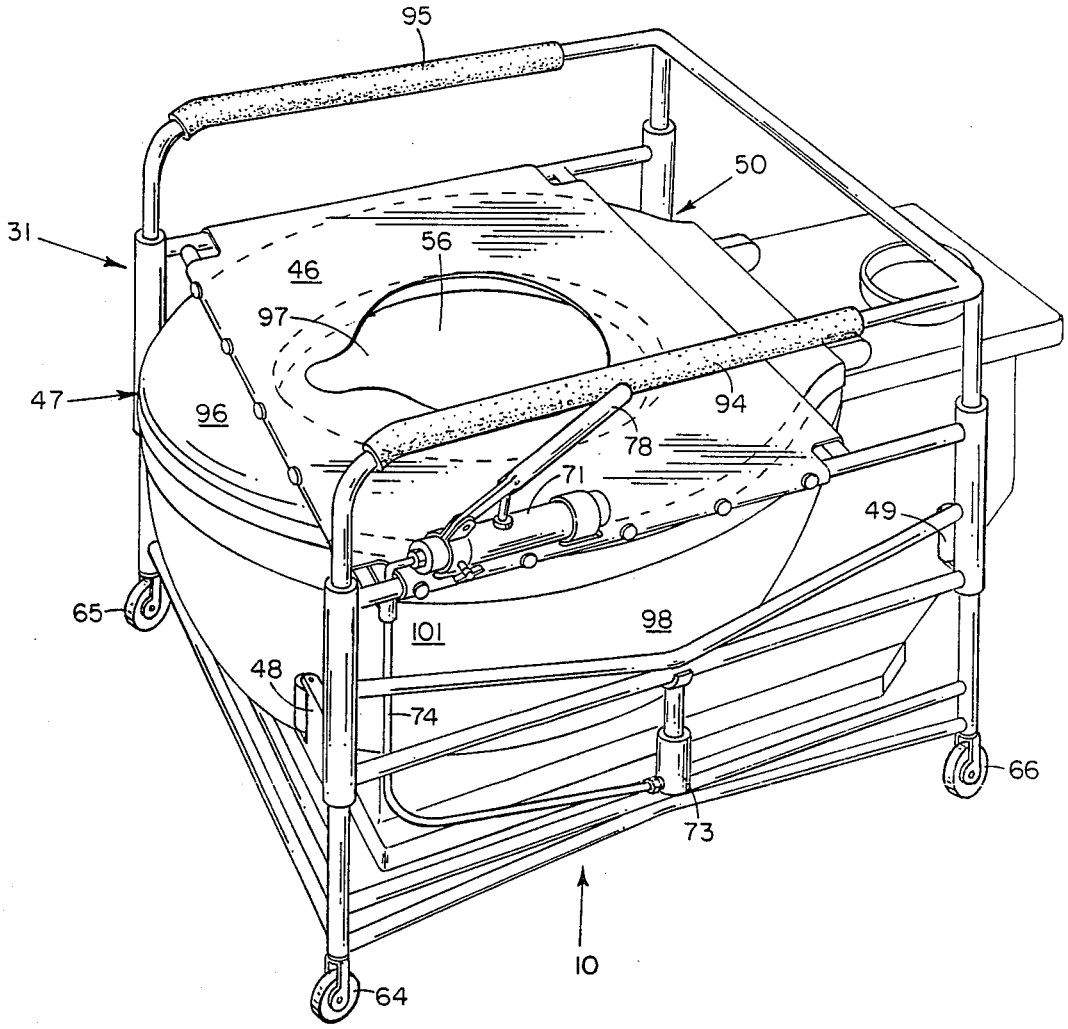
FIG. 2 is an isometric perspective of the preferred embodiment of the present invention in a position relative to a toilet, which position would enable use of the toilet by an individual utilizing the preferred embodiment of the present invention.

The present invention is preferably embodied as a cart for positioning a body on a toilet. This preferred embodiment of a body positioning cart is shown generally in FIG. 1. The basic components of the preferred embodiment are a rigid support structure 10, seat carriage 31 which is vertically movable relative to rigid support structure 10, pneumatic system 70 for adjusting the elevation of seat carriage 31 relative to support structure 10, and castors 64 through 67 connected to support structure 10 for enabling movement of the preferred embodiment on a surface, such as floor surface 100. Orientations of the preferred embodiment are described relative to a position in which castors 64 through 67 rest on floor surface 100, which floor surface 100 is horizontal.

Rigid support structure 10, more specifically, includes support members 21 through 30 and fundamental member 11. Support members 21 through 30 and fundamental member 11 are bonded together at each of their connections (not numbered but discussed further in the following paragraphs) to form a rigid support structure 10 which is sturdy. Each of support members 21 through 30 and fundamental member 11 is comprised of metallic tubing, and the connections between any two of fundamental member 11 and support members 21 through 30 are welded connections (not numbered). Fundamental member 11 has bends 12 through 15 which distinguish straight sections 16 through 20. Straight sections 16 and 17 are vertical, and straight sections 18 through 20 are horizontal.

Support members 23 and 24 are each horizontal and are connected to and between straight sections 16 and 17. Horizontal members 23 and 24 are straight and parallel being connected to straight sections 16 and 17 at respectively different elevations for enabling support of fundamental member 11. A first longitudinal end of each of support members 23 and 24 is connected to straight section 16, and a second longitudinal end of each of support members 23 and 24 is connected to straight section 17. Support section 16 is a horizontally positioned straight member connected to and between straight section 17 and support member 22. Support member 25 is a horizontally disposed straight member connected to and between straight member 16 and support member 21. Support members 26 and 25 are each at the same elevation as support member 24, and each of support members 25 and 26 are positioned at right angles relative to support member 24. Support members 21 and 22 are connected to the underside of straight members 18 and 19, respectively, near bends 13 and 14, respectively. Support members 21 and 22 are positioned vertically. Support member 27 is connected to and between straight section 16 and support member 21 at the lower ends of each 16 and 21, respectively. Support member 28 is connected to and between the respective lower ends of straight section 17 and support member 22. Support members 27 and 28 have bends 29 and 30, respectively, at their respective mid-points. At bend 29, support member 27 is connected to the longitudinal mid-point of support member 25. At bend 30, support member 28 is connected to the mid-point of support section 16. Support member 28 is co-planar with an imaginary plane formed between support members 26 and 22. Support member 27 is co-planar with an imaginary plane shared by support members 25 and 21.

Grips 94 and 95 are provided on fundamental member 11 for enabling gripping of the preferred embodiment by a person during the use of the preferred embodiment. Grips 94 and 95 also enable protection of an individual from harmful impact with the preferred embodiment. Grips 94 and 95 are tubular in their shape and the inner surfaces of grips 94 and 95 are bonded to straight sections 19 and 18, respectively. Grips 94 and 95 are composed of foam rubber.

Seat carriage 31 basically includes cylindrical guide members 32 through 35, structural members 36 through 43, guide rollers 47 through 50, and seat 46. Each of the connections (not numbered but discussed further in the following paragraphs) between any two of structural members 36 through 43 and cylindrical guide members 32 through 35 are weld connections, and each of cylindrical guide members 23 through 35 as well as structural members 36 through 43 are tubular metallic members. Cylindrical guide members 32 through 35 are each vertically slideable relative to straight sections 32 and 33 and support members 22 and 21, respectively. Such vertical slidability of guide members 32 through 35 is limited by bends 12, 15, 14 and 13, respectively, at the upper extreme, and such slidability is limited at the lower extreme by the mechanical limits of jacks 72 and 73. Each of cylindrical guide members 32 through 35 are positioned concentrically about straight sections 16 and 17 and support members 22 and 21, respectively.

Support member 36 is connected to and between the respective lower ends of cylindrical guide members 33 and 34 and is straight and horizontal. Support member 38 is connected to and between the respective lower ends of cylindrical guide members 32 and 35 and is straight and horizontal. Support member 37 is connected to and between the respective upper ends of cylindrical guide members 33 and 34 and is straight and horizontal. Support member 39 is connected to and between the respective upper ends of cylindrical guide members 32 and 35 and is straight and horizontally positioned. Support member 42 is connected to and between cylindrical guide members 33 and 34 at points 51 and 52, respectively. Support member 43 is connected to and between cylindrical guide members 32 and 35 at points 53 and 54, respectively. Points 51 through 54 are at the same elevation relative to each other of 51 through 54, which same elevation is approximately equidistant from members 36 and 37. Support member 42 has bend 44 at its longitudinal mid-point, and bend 44 is connected to support member 36 at the longitudinal mid-point of support member 36. Support member 43 has a bend (not shown but similar to bend 44 of member 42) at the longitudinal mid-point of member 43, which bend is connected to support member 38 at the longitudinal mid-point of support member 38.

A single imaginary plane is shared by cylindrical guide members 33 and 34 and each of structural members 36, 37 and 42. A single imaginary plane is shared by each of cylindrical guide members 32 and 35 and each of structural members 38, 39 and 43. Structural members 40 and 41 are each horizontal and are each connected to and between support members 37 and 39. Support member 40 is parallel to support member 41. The longitudinal ends of support member 40 are connected at the respective longitudinal ends of support members 37 and 39, which ends of support members 37 and 39 are connected to cylindrical guide members 32 and 33. Cylindrical guide members 32 through 35 and structural members 36 through 43 are bonded together to form seat carriage 31 which is rigid and sturdy.

Seat 46 is formed of a generally square shaped section of plastic fabric which is connected by rivets 55 to each of structural members 37 and 39 through 41. The plastic fabric of seat 46 is a thick plastic fabric which is flexible and strong for enabling support of a human body. Rivets 55 (only some of which are shown) connect seat 46 to each of members 37 and 39 through 41 in a fashion which enables seat 46 to be generally taut over a roughly square-shaped space between the upper surfaces of each of structural members 37 and 39 through 41.

Seat 46 also has opening 56 through the fabric of seat 46 primarily for enabling passage of wastes from a body seated on seat 46 to the space beneath seat 46, which space beneath seat 46 ideally contains a toilet (not shown) during the period of such waste passage. The general shape of opening 56 is an oval shape approximately centered relative to the square-shaped space formed between structural members 37 and 39 through 41. Further, the oval shape of opening 56 is elongated having its longitudinal direction parallel to structural member 37. The shape of opening 56 also includes a forwardly extending discontinuity 57 in the oval shape of opening 56. Discontinuity 57 extends toward structural member 40 from the oval shape of opening 56. Discontinuity 57 is particularly adapted for enabling dependence of body parts through opening 56, which body parts depend from the body and through the area approximately between the legs of a person seated on seat 46 in an ordinary fashion Discontinuity 57 also enables upward passage of portions of toilet seats particularly adapted for handicapped individuals, such as the upward protrusion of the crotch seal of Applicant's co-pending application, Ser. No. 052,720, filed May 20, 1987.

Forward guide rollers 47 and 48 are structurally identical to each other of 47 and 48, and rear guide rollers 49 and 50 are structurally identical relative to each other of 49 and 50. Exemplary of guide rollers 47 and 48, guide roller 47 further includes cylindrical roller 58, tabs 61 and 62 (62 not shown but similar to 61), and roller support 63. Note that the "plane of roller support 63" is a vertical plane through the axis of cylindrical roller 58 and through the cylindrical axis of cylindrical guide member 32. Cylindrical roller 58 has axially protruding pins 59 and 60 (60 not shown) which are rigid extensions of cylindrical roller 58. Pins 59 and 60 are rotatably disposed through holes in tabs 61 and 62, respectively Tabs 61 and 62 are integrally connected with roller support 63.

Roller support 63 of guide roller 47 is rigidly bonded to the lower portion of cylindrical guide member 32 in an orientation such that the plane of guide roller 47 is coplanar with an imaginary plane formed between cylindrical guide member 32 and support member 23. The roller support of guide roller 48, similarly, is rigidly bonded to cylindrical guide member 33 in an orientation such that the plane of guide roller 48, which plane is vertical and includes the rotational axis of the cylindrical roller of guide roller 48, is coplanar with the plane of guide roller 47. Rear guide rollers 49 and 50 include cylindrical rollers (not numbered) which are similar to cylindrical roller 58. The pins of the cylindrical rollers of guide rollers 49 and 50 are rotatably disposed through tabs 99 (only one of which is shown), which tabs 99 are similar to tabs 61 and 62. The cylindrical rollers of guide rollers 49 and 50, having vertical axes, thus are each rotatably disposed between the holes of two of tabs 99. Tabs 99, further, are rigidly bonded to cylindrical guide members 34 and 35, respectively, in an orientation such that the axes of the cylindrical rollers of guide rollers 49 and 50 are each co-planar with an imaginary plane shared by both support members 21 and 22. More particularly, the relative positions of guide rollers 47 through 50 are such that they enable guiding of the preferred embodiment relative to a toilet as the preferred embodiment is moved rearward over such toilet. Such enabled guiding by guide rollers 47 through 50 centers opening 56 over the excretion chamber opening as well as over the seat opening of such toilet when such seat is in its lowered position.

Castors 64 through 67 are provided at the lower ends of straight sections 17 and 16 and support members 22 and 21, respectively. Castors 64 through 67 are standard castors having two degrees of rotational freedom, one degree about the axis of the wheel of each castor and a second degree of rotational freedom about a second axis, which second axis is oriented vertically for each of castors 64 through 67. The lower ends of straight sections 16 and 17 and support members 21 and 22 are adapted to securely receive and enable operative rotation of castors 64 through 67.

Pneumatic system 70 includes pump 71, pneumatic jacks 72 and 73, and hydraulic lines 74 and 75. Pneumatic pump 71 is securely mounted with brackets (not numbered) to structural member 37. Small, roughly rectangular shaped openings 91 and 92 are provided through the fabric of seat 46, and the brackets mounting pump 71 to structural member 37 are disposed through openings 91 and 92. Jack 72 is identical to jack 73, and each of pneumatic jacks 72 and 73 are standard pneumatic jacks such as the "midget" sized pneumatic jack produced under the mark of PORTO-POWER As such jacks 72 and 73 are each adopted to be controlled by fluid pressure communicated through a high pressure fluid line such as 75 and 74, respectively. Such fluid pressure controls jacks 72 and 73 for elevating and lowering a ram (such as 90) which is a component of the particular pneumatic jack. Ram 90 is such a ram of pneumatic jack 73.

Pneumatic jack 73 is connected by welds to each of support member 26 and structural member 36 for adjusting the elevation of seat carriage 31 relative to the elevation of rigid support structure 10. Ram 90 of jack 73 has a vertical axis, and the upper end of ram 90 is rigidly connected to the underside of structural member 36 at the longitudinal mid-point of structural member 36. The base of jack 73 is rigidly connected to the upper surface of support member 26. Pneumatic jack 72 is connected relative to support member 25 and structural member 38 in a relation similar to the connection of pneumatic jack 73 relative to support member 26 and structural member 36.

Pneumatic pump 71 is operable to simultaneously control each of pneumatic jacks 72 and 73. Such control is effectuated by manipulations of pump arm 78 and pressure release valve 79. Pneumatic pump 71 is a standard pneumatic pump for pumping air through stem 77. Pump 71 includes cylindrical pump chamber 93, pressure release valve 79 for enabling gradual release of pressure from within stem 77, and pump arm 78. Pump arm 78 is pivotally connected to cylindrical pump chamber 93 and is co-planar with an imaginary plane shared by structural member 37 and the cylindrical axis of pump chamber 93.

The cylindrical axis of pump chamber 93 is parallel to structural member 37, but pump chamber 93 is slightly canted outwardly from a position directly above structural member 37, thereby positioning pump 71 in an orientation such that pump arm 78 avoids collision with straight section 19 and with grip 94.

As pump arm 78 is cranked about its pivotal connection to pump chamber 93, air is pumped through stem 77, thereby causing the rams of jacks 72 and 73 to be equally and simultaneously elevated. Subsequent release of pressure by proper manipulation of valve 79 causes the respective rams of jacks 72 and 73 to equally and simultaneously become lowered. Thus, since the rams of jack 72 and 73 are rigidly connected to structural members 38 and 36, respectively, manipulations of pump arm 78 and valve 79 control the elevation of seat carriage 31.

Stem 77 and lines 74 and 75 are hollow tubular lines for enabling communication of highly pressurized fluid. Line 74 is operatively connected to pneumatic jack 73 for enabling control of pneumatic jack 73, and line 75 is operatively connected to pneumatic jack 72 for controlling pneumatic jack 72. T-connection 76 is sealingly connected to each of lines 74 and 75 and stem 77 for enabling open fluid communication between the fluids contained within stem 76 and each of lines 74 and 75. Such open communication between stem 76 and each of line 74 and 75 is such that the pressure in line 74 is approximately equal to the pressure in line 75. Each of lines 74 and 75 have configuration relative to support structure 10 and to seat carriage 31 as shown in FIG. 1; however, lines 74 and 75 are not fixed in relation to support structure 10 or to seat carriage 31, rather lines 74 and 75 are flexible in order to elastically bend as seat carriage 31 moves relative to structure 10.

In use, the particular individual (for which the present invention is being utilized) must first be positioned in a seated position on seat 46. Such seated position on seat 46, ideally, is one in which the excretory organs of the individual are positioned above opening 56 with the individual's body being approximately centered between grips 94 and 95, and such seated position is also one in which the individual's legs extend over structural member 40. Based on this ideal seated position of the individual's body, the side of the preferred embodiment which includes structural member 40 is termed "the front" of the preferred embodiment, and the side of the preferred embodiment including straight section 20 is naturally referred to as "the rear" of the preferred embodiment. Due in part to the flexible nature of seat 46 and in part to the apparent functional symmetry of the preferred embodiment as a whole, it is natural that the individual's excretory organs are approximately centered relative to seat 46, and the individual's excretory organs thus tend to be positioned in an ideal position for use of the preferred embodiment of the present invention. Thus, in an area separate from the typically crowded space adjacent a toilet, the individual may be easily seated on seat 46 in the ideal seated position. In such ideal seated position on seat 46, an individual may be transported on the preferred embodiment of the present invention and may also utilize a toilet positioned beneath seat 46 in an orientation such as that exemplified in FIG. 3.

The rigid support structure 10 of the preferred embodiment has a configuration which, in combination with castors 64 through 67, enables rearward movement of the preferred embodiment over the excretion chamber of a standard toilet. Referring now to FIG. 3, the preferred embodiment is shown in an orientation relative to standard toilet 98 in a position such that an individual seated properly (i.e., approximately in the previously described ideal seated position) on seat 46 may utilize toilet 98. As support structure 10 is rearwardly moved over toilet 98 toward the orientation shown in FIG. 3, guide rollers 47 through 50 (50 being shown only in FIG. 1) automatically center opening 56 relative to the excretion chamber opening 97 of toilet 98. As is typical on many standard toilets, outer surface 101 of toilet 98 roughly has a semielliptical shape when viewed from above toilet 98, which roughly semielliptical shape is symmetrical about an axis running front to rear with the vertex of the shape being in the front of toilet 98. During the rearward movement of the preferred embodiment over toilet 98, rear guide rollers 49 and 50 first engage outer surface 101 of toilet 98, and front guide rollers 47 and 48 engage the outer surface of toilet 98 as the preferred embodiment moves further rearward over toilet 98. In the course of such rearward movement, opening 56 tends to become centered above excretion chamber opening 97 due to the interacting characteristics of guide rollers 47 through 50 and outer surface 101. When opening 56 is ideally situated over excretion chamber opening 97, front guide rollers 47 and 48 prevent further rearward movement of the preferred embodiment.

However, before rearwardly moving the preferred embodiment over a toilet such as toilet 98, seat carriage 31 must be sufficiently elevated to enable clearance of seat 46 and the individual's body thereon above the upper surface of the seat of the toilet. Relative to toilet 98 of FIG. 3, when opening 56 is properly centered over excretion chamber opening 97, seat carriage 31 is lowered for allowing seat 46 to rest upon seat 96 of toilet 98. Such raising and lowering of the seat 46 and the body thereon is effectuated by appropriately manipulating pneumatic system 70 as previously discussed. Particularly, such raising and lowering is effectuated by manipulating pump arm 78 and pressure release valve 79. Once lowered upon the seat of the particular toilet, seat 46 enables a seal to be formed between the lower surface of the body of the individual seated on seat 46 and the surface of the seat of the particular toilet.

When use of toilet 98 is completed by the individual seated on seat 46, seat 46 is again elevated by appropriate manipulation of pneumatic system 70, and the body of the individual seated on seat 46 is raised. Once the body of the individual seated on seat 46 is raised, support structure 10 is again free to move on castors 64 through 67 and may thus be moved forwardly from above toilet 98. The individual seated on seat 46 may then be transported to another desired location.

Note that the relative positions of guide rollers 47 through 48 and other components of the present invention are specifically adapted for enabling the centering of opening 56 over an excretion chamber of a toilet having characteristics similar to that of toilet 98; and as in alternative embodiment (not shown) this relative positioning of guide rollers 47 through 50 may be modified for adapting the present invention to toilets having significantly different characteristics relative to toilet 98.

Many alternative embodiments of the present invention can be configured by rearrangement of the elements of the preferred embodiment or by substitution to produce similar results. Such modifications include reconfiguring the elements of the preferred embodiment in order to adapt a cart for use in conjunction with variously differently shaped toilets, replacement of castors 66 and 67 with wheels similar to those known to be used on wheel chairs for enabling movement of the cart of the preferred embodiment by the individual seated on seat 46, replacing pneumatic system 70 with an electronically controlled and empowered hydraulic system, and many others. It is, therefore, the desire of Applicant not to be bound by the description of this invention as contained in this specification but to be bound only by the claims as appended hereto.

We claim:

1. An apparatus enabling use of a toilet by an individual, which toilet has an excretion chamber opening, comprising:

a support structure adapted to be positionable relative to an excretion chamber opening of a toilet;

supporting means for supporting the body of an individual, said supporting means being movable to rest on said toilet and said supporting means defining a passage for enabling passage of defecation from said body through the excretion chamber opening of said toilet;

means, operatively connected between said support structure and said supporting means, for raising said supporting means off of said toilet to enable horizontal movement of said support structure relative to said toilet; and means for centering said passage above the excretion chamber opening of said toilet, said centering means comprising guides which are rotatably mounted to said support structure for guiding horizontal movement of said support structure relative to said toilet.

2. The apparatus of claim 1 further comprising means, operatively connected to said support structure, for enabling horizontal movement of said support structure relative to said toilet.

3. The apparatus as in claim 2, wherein said horizontal movement enabling means comprises a caster mounted on said support structure enabling horizontal movement of said support structure relative to the toilet.

4. The apparatus of claim 1 wherein said guides are mounted to said support structure in a spaced relation corresponding to a transverse dimension of said toilet.

5. The apparatus of claim 1 wherein said guides are rotatably mounted about vertical axes.

6. The apparatus as in claim 1, further comprising a seat integrally formed with said supporting means.

7. The apparatus of claim 1, wherein said raising means further comprises:

a cylindrical guide for guiding movement of said supporting means in the vertical direction relative to said support structure, which cylindrical guide is rigidly connected to said supporting means and is slideably engaged with said support structure; and means for controlling the elevation of said supporting means relative to said support structure.

8. The apparatus of claim 7 wherein said elevation controlling means comprises a pump having a means for enabling operation thereof.

9. The apparatus of claim 8 wherein said operation enabling means is mounted to said supporting means.

10. The apparatus of claim 9 wherein said operation enabling means comprises a lever pivotally mounted to said supporting means.

11. The apparatus of claim 8 wherein said raising means further comprises a pneumatic jack connected between said supporting means and said support structure, said pneumatic jack being operatively connected to said pump for controlling the elevation of said supporting means relative to said support structure in response to the operation of said pump.

* * * * *